US009476430B2

(12) United States Patent
Immendoerfer et al.

(10) Patent No.: US 9,476,430 B2
(45) Date of Patent: Oct. 25, 2016

(54) METHOD AND DEVICE FOR ACTIVATING AN ACTUATOR ELEMENT IN A MOTOR SYSTEM FOR A MOTOR VEHICLE

(75) Inventors: Ingo Immendoerfer, Tamm (DE); Alex Grossmann, Leonberg (DE); Udo Sieber, Bietigheim (DE); Ralf Buehrle, Hochberg (DE); Zeynep Tosun, Istanbul (TR)

(73) Assignee: Robert Bosch GmbH, Stuttgart (DE)

( * ) Notice: Subject to any disclaimer, the term of this patent is extended or adjusted under 35 U.S.C. 154(b) by 492 days.

(21) Appl. No.: 14/001,515

(22) PCT Filed: Jan. 4, 2012

(86) PCT No.: PCT/EP2012/050089

§ 371 (c)(1),
(2), (4) Date: Feb. 7, 2014

(87) PCT Pub. No.: WO2012/116849

PCT Pub. Date: Sep. 7, 2012

(65) Prior Publication Data

US 2014/0144316 A1 May 29, 2014

(30) Foreign Application Priority Data

Mar. 1, 2011 (DE) ..... 10 2011 004 890

(51) Int. Cl.
*F15B 11/08* (2006.01)
*F02D 11/10* (2006.01)
(Continued)

(52) U.S. Cl.
CPC ..... *F15B 11/08* (2013.01); *F02D 11/107* (2013.01); *F02D 41/062* (2013.01); *F02D 9/105* (2013.01); *F02D 41/042* (2013.01); *F02D 2011/108* (2013.01); *F02D 2200/0404* (2013.01)

(58) Field of Classification Search
CPC ..... F15B 11/08
USPC ..... 318/568.16, 568.11, 568.1, 567, 560
See application file for complete search history.

(56) References Cited

U.S. PATENT DOCUMENTS 4,740,738 A * 4/1988 El-Antably ..... H02P 3/065 318/701
5,497,330 A 3/1996 Ishida
(Continued)

FOREIGN PATENT DOCUMENTS

CN 1900501 A 1/2007
DE 37 43 309 A1 6/1989
(Continued)

OTHER PUBLICATIONS

International Search Report corresponding to PCT Application No. PCT/EP2012/050089, mailed Apr. 12, 2012 (German and English language document) (8 pages).

*Primary Examiner* — David S Luo
(74) *Attorney, Agent, or Firm* — Maginot, Moore & Beck LLP

(57) ABSTRACT

The disclosure relates to a method for operating a positioning actuator system with an electronically commutated actuator drive for driving an actuator element, having the following steps: non-volatile storage of a position information item of the actuator element or of a rotor of the actuator drive which was detected last as a reference position before the positioning actuator system is switched off; in the case of switching on of the positioning actuator system retrieval of the reference position and actuation of the actuator drive by energizing the actuator drive in accordance with a space phasor which is dependent on the reference position. The object is to make available an improved method for releasing blockage of an actuator element or actuation after activation of a motor system with a maximum actuating torque. For positioning actuators with commutated motors such as, for example, synchronous motors.

8 Claims, 2 Drawing Sheets

(51) Int. Cl.

| | |
|---|---|
| ***F02D 41/06*** | (2006.01) |
| *F02D 9/10* | (2006.01) |
| *F02D 41/04* | (2006.01) |

(56) References Cited

U.S. PATENT DOCUMENTS

| | | | | |
|---|---|---|---|---|
| 5,796,235 | A * | 8/1998 | Schrodl | H02P 6/185 318/400.11 |
| 7,279,865 | B2 * | 10/2007 | Matsuo | H02P 21/18 318/767 |
| 8,007,330 | B2 * | 8/2011 | Wong | B63H 20/12 440/61 S |
| 2007/0017482 | A1 | 1/2007 | Nakashima et al. | |
| 2008/0258666 | A1 | 10/2008 | Carmen et al. | |

FOREIGN PATENT DOCUMENTS

| | | | |
|---|---|---|---|
| DE | 41 35 913 | A1 | 5/1993 |
| DE | 100 17 546 | A1 | 10/2001 |
| EP | 0 391 930 | B1 | 1/1992 |
| EP | 1 338 775 | A2 | 8/2003 |
| FR | 2 943 721 | A1 | 10/2010 |
| JP | 2-41689 | A | 2/1990 |
| JP | 2003-50072 | A | 2/2003 |
| JP | 2007-23933 | A | 2/2007 |
| JP | 2008-101561 | A | 5/2008 |

* cited by examiner

METHOD AND DEVICE FOR ACTIVATING AN ACTUATOR ELEMENT IN A MOTOR SYSTEM FOR A MOTOR VEHICLE

This application is a 35 U.S.C. §371 National Stage Application of PCT/EP2012/050089, filed on Jan. 4, 2012, which claims the benefit of priority to Serial No. DE 10 2011 004 890.1, filed on Mar. 1, 2011 in Germany, the disclosures of which are incorporated herein by reference in their entirety.

The disclosure relates to positioning actuators having an electronically commutated drive which are used in environments in which a blockage can occur during activation. In particular, the disclosure relates to measures for releasing the blockage and for determining a rotor position of a rotor of the electronically commutated drive, in order to provide maximum torque.

BACKGROUND

Drives for positioning actuators can have electronically commutated motors, for example. An electronically commutated motor, such as a synchronous motor, has a rotor with permanent magnets, which moves relative to a stator. The stator is provided with a plurality of stator coils, the energization of the stator coils in the correct rotor position generating a motor magnetic field which interacts with an excitation magnetic field generated by the permanent magnets in such a way that a desired drive force acts on the rotor. In order to achieve maximum efficiency, it is desirable that the motor magnetic field has a lead of 90° of an electric position angle in relation to the excitation magnetic field. For this reason, for the purpose of energizing the stator coils as a function of rotor position, information relating to the position of the rotor is needed. This rotor position can either be detected via sensors or determined by what are known as sensor-less methods for position detection.

By using the rotor position of the rotor and the desired direction of movement, an appropriate commutation pattern can be provided by a suitable control unit, said pattern determining how the stator coils are to be driven in order to provide the necessary drive force or the necessary torque.

In simple synchronous motors, the detection of the rotor position is carried out by an internal position sensor but there is also the possibility of arranging the position sensor externally on the actuator element or of additionally using a position sensor arranged there for the determination of the rotor position. As a result, the expenditure both for the synchronous motor and for the cabling between the synchronous motor and a control device can be reduced.

A synchronous motor can be driven with various types of commutation; in order to achieve the maximum drive moment, the motor magnetic field generated by the stator coils should if possible be set leading by 90° in the direction of movement in relation to the excitation magnetic field generated by the permanent magnets of the rotor. A deviation from this lead by 90° leads to a decrease in the drive force and the drive moment. In order to achieve driving always with the maximum possible torque, accurate rotor position information is necessary. Deviations between real and measured rotor position, which can be caused by sensor tolerances and resolution inaccuracies, for example, to some extent lead to considerable reductions in the efficiency.

In particular in an implementation of the positioning actuator with an external position sensor which picks up position information on an actuator element which is coupled by a step-down gearbox, the deviation between real and measured rotor position can be intensified further. One example in which an external position sensor can be provided is, for example, the throttle flap actuator, in which position feedback of the position of the throttle flap is present in any case in order to obtain accurate position information about the throttle flap. Use of the position information from the position sensor arranged on the throttle flap also for the commutation of the synchronous motor driving the throttle flap can lead to the aforementioned deviations and, as a result, to a considerable reduction in the actuating moment provided by the synchronous motor.

At very low temperatures, to which the motor system can be exposed, it is possible for icing to occur. This blocks the movement of the actuator element when operation of the motor system is resumed. In order to release this blocked state, in particular to carry out re-calibration of the rotor position by moving to a reference position or by moving to an end position, a maximum actuating moment from the synchronous motor is required immediately upon commencement of the starting process. In order to provide this maximum actuating moment, it is necessary for the deviation between real and measured rotor position to be as small as possible, so that the actuating moment can be as great as possible. On account of the temperature, however, a correspondingly pronounced temperature drift of the position sensor can lead to a significant error angle and therefore cause impermissible weakening of the torque of the synchronous motor. Under certain circumstances, the torque weakening can lead to it not being possible to release the iced actuator element from its blockage, and thus the motor system is not operational.

Furthermore, the position sensor on the actuator element is formed only as a relative position sensor, so that when activating the actuating system, the actual position of the rotor is not defined. While, for the purpose of calibration, the actuator element is normally moved to a predefined end stop, in order then to be able to drive the actuator element in an optimal way, this is not possible in the event of blockage of the actuator element, so that initial driving of the rotor with a maximum drive force is not possible.

The document DE 41 35 913 A1 discloses a method for controlling an adjusting device wherein, during the pre-starting phase and/or and after shutting down the drive unit or the vehicle, the adjusting device is moved at least once over the major part of its maximum possible movement range, starting from an arbitrary position for every possible direction of movement, so that, at least on one side, said adjusting device is led outside its normal operating movement range. In this way, jamming can be prevented.

The document DE 37 43 309 A1 discloses a method and a device for detecting a jammed or firmly frozen actuator element of an internal combustion engine, wherein the actuator element is shaken loose in the event of jamming. The shaking loose action can be carried out, for example, by the electric drive of the adjusting device being driven in a reversing manner.

The document DE 100 17 546 A1 discloses a method for detecting a blockage of the throttle flap on the basis of an actual value and a set point of the position of the throttle flap. Following the detection of a blockage, the set point for the position of the throttle flap is varied.

The document EP 0 391 930 B1 discloses a method for setting an operating characteristic of an internal combustion engine, wherein jamming of an actuator element for setting the air supply of the internal combustion engine is detected by using the deviation between predefined and instantaneous position and, if jamming is detected, the actuator element is caused to make a periodically shaking movement in order to release the jamming.

It is an object of the present disclosure to provide an improved method for releasing a blockage of an actuator element of a positioning actuator and/or for driving with a maximum actuating moment following activation of the motor system.

SUMMARY

This object is achieved by a method for driving a positioning actuator as described herein and by the device and the positioning actuator system also described herein.

According to a first aspect, a method for operating a positioning actuator system having an electronically commutated actuating drive for driving an actuator element is provided. The method comprises the following steps:

non-volatile storage of an item of position information about the actuator element or a rotor of the actuating drive which was detected last as a reference position before the positioning actuator system is switched off; and when the positioning actuator system is switched on, retrieving the reference position and controlling the actuating drive by energizing the actuating drive in accordance with a space phasor which depends on the reference position.

One idea of the above method consists in that, as soon as an actuator element has assumed its rest position after the positioning actuator system has been switched off, for example in the overrun phase of the motor control system during a stoppage of an internal combustion engine, the assumed position of the actuator element is detected and is stored in a non-volatile manner in the control device as a reference position. When the positioning actuator system is re-started, the position detector can be calibrated or adjusted with the reference position, so that the positioning actuator can be energized in accordance with a suitable space phasor. This means that the actuating drive can be driven in such a way that the electronically commutated actuating drive generates a motor magnetic field which is substantially perpendicular to the position of the excitation magnetic field, which depends directly on the rotor position.

Furthermore, provision can be made that, after the positioning actuator system has been switched on, it is determined whether the actuator element is blocked; if it is established that the actuator element is blocked, the actuating drive is energized in accordance with a space phasor which varies around a space phasor corresponding to the reference position. In particular, provision can be made that, if it is determined that the actuator element is blocked, the actuating drive is driven with space phasors which vary by 180° around an electric rotor position.

Furthermore, after the positioning actuator system has been switched on, it is determined whether the actuator element is blocked; if it is determined that the actuator element is blocked, the actuating drive is energized in accordance with a revolving space phasor. Provision can further be made for a frequency of revolution of the revolving space phasor to correspond to a predefined frequency of revolution at which the positioning actuator system exhibits resonance, so that the actuating force is increased as compared with the maximum actuating force from the actuating drive.

Alternatively, a frequency of revolution of the revolving space phasor can be varied.

According to a further aspect, a device for operating a positioning actuator system having an electronically commuted actuating drive for driving an actuator element is provided, the device being constructed for non-volatile storage of an item of position information of an actuator element or a rotor of the actuating drive which was detected last as a reference position before the positioning actuator system is switched off; and when the positioning actuator system is switched on, to retrieve the reference position and to drive the actuating drive by energizing the actuating drive in accordance with a space phasor which depends on the reference position.

According to a further aspect, a positioning actuator system is provided. The positioning actuator system comprises:

an actuator element;

an electronically commutated actuating drive for driving the actuator element;

a control device which is connected to a non-volatile memory in order to store an item of information about the position of the actuator element which was detected last as a reference position before the positioning actuator system is switched off;

wherein the control device is designed to retrieve the reference position when the positioning actuator system is switched on and to drive the actuating drive by energizing the actuating drive in accordance with a space phasor which depends on the reference position.

According to a further aspect, a computer program product is provided which contains program code which, if it is executed on a data processing unit, carries out the above method.

BRIEF DESCRIPTION OF THE DRAWINGS

Preferred embodiments will be explained in more detail below by using the appended drawings, in which.

DETAILED DESCRIPTION

Figure 1:
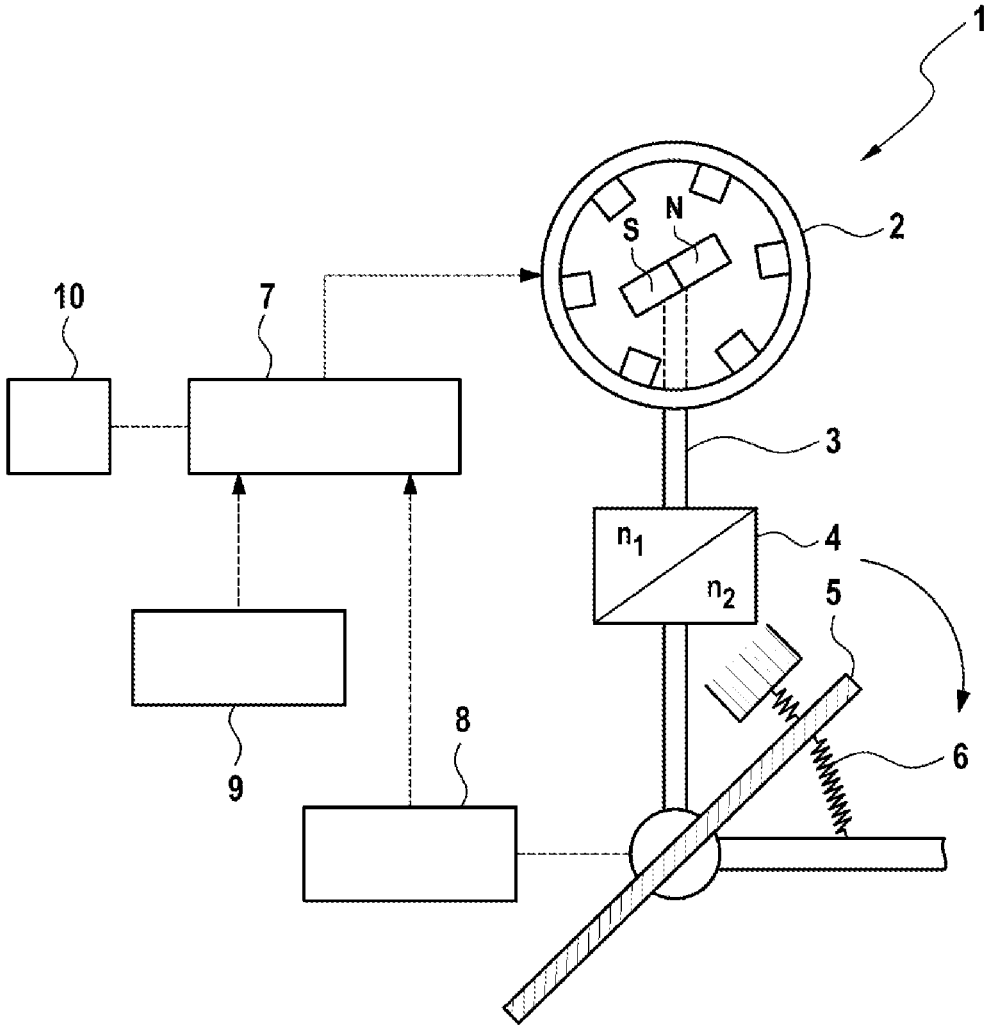
FIG. 1 shows a schematic representation of a positioning actuator system having a positioning actuator for positioning a throttle flap of an internal combustion engine in a motor system.

FIG. 1 shows a schematic representation of a positioning actuator system 1 having an actuating motor which is formed as an electronically commutated synchronous motor. The synchronous motor 2 is constructed as an internal rotor motor, the output shaft 3 of which is coupled via a gearbox 4 to an actuator element 5, such as a throttle flap or the like. The throttle flap 5 has a restoring force applied to it via a restoring spring 6, so that, when the throttle flap 5 is not energized, the latter is arranged in a specific actuating range, e.g. at or close to an end stop.

The synchronous motor 2 is driven by a control device 7 in order to provide a specific positioning moment, which acts on the actuator element 5 via the gearbox 4. As a rule, position control is implemented in the control device 7 and, with the aid of a position control loop implemented in the control device 7, sets a desired intended position of the actuator element 5. For this purpose, the actuator element 5 is coupled to a position sensor 8, which transmits information about the position of the actuator element 5 to the control device 7. On the basis of the information about the intended position of the actuator element 5 provided in the control device 7 and of the actual position of the actuator element 5 provided by the position sensor 8, the synchronous motor 2 can be driven in such a way that a specific actuating moment acts on the actuator element 5 via the gearbox 4. The angle to which the actuator element 5 is to be set is determined in the control device 7 on the basis of a gas pedal position provided by a gas pedal 9, i.e. on the basis of a driver stipulation, and under certain circumstances further system variables, and is predefined as an intended position for the position control loop. The control device 7 is also connected to a non-volatile memory 10, in order to store parameters such as correction parameters or the like permanently, even when the positioning actuator system 1 is switched off.

At very low temperatures and when the positioning actuator system 1 is stopped, e.g. when the internal combustion engine switched off, it is possible for icing of the actuator element 5 to occur. Under certain circumstances, the icing can block the movement of the actuator element 5, so that it becomes necessary to release the blocked state immediately upon commencement of the starting process of the internal combustion engine. This can be achieved, for example, by providing a maximum torque by means of the synchronous motor 2. For this reason, even during the commencement of the starting process of the internal combustion engine, it is necessary to know the relative position of the synchronous motor 2 exactly in order that the lowest possible reduction in the actuating moment occurs on account of an inaccurate determination of the rotor position.

However, on account of the low temperatures and with a correspondingly pronounced temperature drift of the position sensor 8, it is possible to draw only inaccurate conclusions about the rotor position, which leads to a significant deviation between the rotor position determined and the real rotor position.

Some positioning actuator systems have relative position sensors which, before activation from a switched-off state, first have to be calibrated by being moved to a previously known position in a merely open-loop control operation of the rotor of the synchronous motor. In the event of any blockage of the actuator element, this calibration cannot be carried out, so that no information about the actual rotor position can be determined with the aid of the position sensor.

If there is no information about the actual rotor position, the rotor of the synchronous motor 2 cannot be driven optimally, i.e. the synchronous motor 2 cannot provide the maximum drive moment in order to release any blockage of the actuator element 5.

Figure 2A:
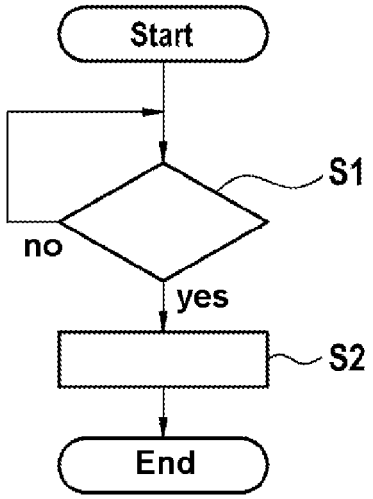
FIG. 2*a* shows a flowchart to illustrate a method for operating the positioning actuator system during a starting phase.
Figure 2B:
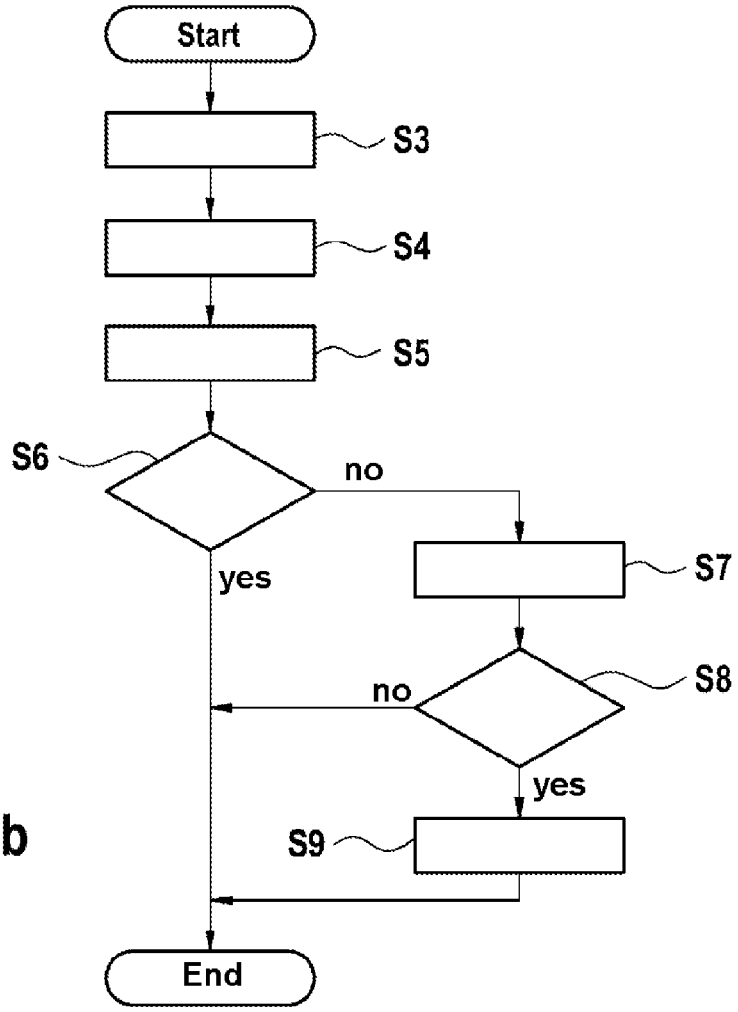
FIG. 2*b* shows a flowchart to illustrate another method for operating the positioning actuator system during a starting phase.

FIGS. 2*a* and 2*b* show a flowchart with which, even during the motor start phase, a maximum torque can be exerted on the actuator element 5.

The flowchart of FIG. 2*a* illustrates a method sequence which, after the internal combustion engine is switched off, is carried out during an overrun phase. Here, the actuator element 5 is monitored (step S1). When the actuator element 5 is at a standstill (alternative: yes), which can be determined, for example, when the synchronous motor 2 is no longer energized, information about the position of the actuator element 5 which was last detected by the position sensor 8 is stored in the non-volatile memory 10 by the control device 7 as a reference position (step S2). Alternatively, a reference rotor position which results from the position of the actuator element position which was last detected can be stored in the non-volatile memory 10.

The flowchart of FIG. 2*b* illustrates a method sequence which can be carried out after the internal combustion engine has been switched on. As the internal combustion engine is started and, at the same time, the positioning actuator system 1 is switched on, the stored item of position information is retrieved from the non-volatile memory 10 as reference (step S3), and the item of position information now provided by the position sensor 8 is corrected with the aid of the stored item of reference position information and the reference rotor position (step S4), in order in this way to eliminate the temperature drift of the position sensor 8. When a relative position sensor 8 is used, the initial calibration (initialization) can be carried out with the aid of the item of reference position information and the reference rotor position.

Then (step S5), blockage detection is carried out by the control device 7 driving the synchronous motor 2 such that an actuating moment is provided which leads to a change in the position of the actuator element 5. If such a position change is recognized in step S6 (alternative: yes), then the flap 5 is not blocked and the positioning actuator system is able to carry out position regulation for the conventional operation of the internal combustion engine on the basis of driver stipulations and the like.

If, in step S6, a blockage of the actuator element 5 is detected (alternative: no), then the synchronous motor 2 is driven with the aid of the control device 7 (step S7) such that the space phasor varies around the space phasor corresponding to the stored reference position, in order in this way to effect a fluctuating actuating moment around the maximum actuating moment that can be provided. By using the varying actuating moment, it is therefore attempted to release the actuator element 5 from the blocked state.

Provision can further be made that, before the alternating energization of the stator coils of the synchronous motor 2 around the stored reference position, a space phasor rotated electrically through 180° is applied to the synchronous motor 2, in order to release any blockage of the positioning actuator system.

If, in step S8, it is determined that, although the space phasor angle has been varied and as a result it has been ensured that the range of a maximum actuating moment has been covered, the blockage has not been released (alternative: yes), then the control device 7 can drive the synchronous motor 2 such that the appropriate space phasor that determines the stator magnetic field is caused to revolve synchronously at a suitable frequency (step S9). Here, the maximum actuating moments in both motor directions of rotation are generated periodically one after another. Shaking is established; for a suitable choice of the frequency of revolution, a resonant increase in the amplitude of the maximum actuating moment generated as a result is achieved and therefore even cranking amplitudes above the maximum actuating moment of the synchronous motor 2 can be generated. In order to achieve the resonance, this method can be carried out with variable frequencies of revolution, for example with an increasing frequency of revolution, so that the range of a resonance of the positioning actuator system can be found.

If, in step S6, no blockage of the actuator element 5 is detected (alternative: yes), or if it is determined in step S8 that the blockage has been released (alternative: no), then the method is terminated.

The invention claimed is:

1. A method for operating a positioning actuator system having an electronically commutated actuating drive for driving an actuator element, comprising:

detecting an item of position information about one of the actuator element and a rotor of the actuating drive as a reference position before the positioning actuator system is switched off;

storing the detected item of position information in a non-volatile storage;

when the positioning actuator system is switched on, retrieving the reference position and driving the actuating drive by energizing the actuating drive in accordance with a space phasor which depends on the reference position;

after the positioning actuator system has been switched on, determining whether the actuator element is blocked; and if the actuator element is blocked, energizing the actuating drive in accordance with a second space phasor which varies around the space phasor corresponding to the reference position.

2. The method as claimed in claim 1 further comprising:

if the actuator element is blocked driving the actuating drive with the second space phasor which varies by 180° around an electric rotor position.

3. The method as claimed in claim 1 further comprising:

after the positioning actuator system has been switched on, determining whether the actuator element is blocked; and if it is determined that the actuator element is blocked, energizing the actuating drive in accordance with a revolving space phasor.

4. The method as claimed in claim 3 wherein a frequency of revolution of the revolving space phasor corresponds to a predefined frequency of revolution at which the positioning actuator system exhibits resonance, so that an actuating force is increased as compared with a maximum actuating force from the actuating drive.

5. The method as claimed in claim 4 wherein the frequency of revolution of the revolving space phasor is varied.

6. A computer program product comprising:

a memory including a program code configured to be executed on a data processing unit to prompt the data processing unit to perform the method as claimed in claim 1.

7. A control device for operating a positioning actuator system having an electronically commuted actuating drive for driving an actuator element, the control device comprising:

a non-volatile memory; and a processor configured to (i) store an item of position information of one of the actuator element and a rotor of the actuating drive detected last as a reference position before the positioning actuator system is switched off and, when the positioning actuator system is switched on, (ii) after the positioning actuator system has been switched on, determine whether the actuator element is blocked, and (iii) retrieve the reference position and, if the actuator element is blocked, drive the actuating drive by energizing the actuating drive in accordance with a space phasor which depends on the reference position.

8. A positioning actuator system comprising:

an actuator element;

an electronically commutated actuating drive configured to drive the actuator element; and a control device connected to a non-volatile memory and configured to (i) store in the non-volatile memory an item of information about a position of the actuator element detected last as a reference position before the positioning actuator system is switched off, (ii) after the positioning actuator system has been switched on, determine whether the actuator element is blocked, and (iii) retrieve the reference position when the positioning actuator system is switched on and, if the actuator element is blocked, to drive the actuating drive by energizing the actuating drive in accordance with a space phasor which depends on the reference position.

* * * * *